US005936187A

United States Patent [19]

Miller et al.

[11] Patent Number: 5,936,187

[45] Date of Patent: Aug. 10, 1999

[54] BLASTING STEMMING PLUG

[75] Inventors: Joseph T. Miller; Robert B. Brown, both of St. Louis County, Mo.

[73] Assignee: MOCAP Incorporated, St. Louis, Mo.

[21] Appl. No.: 08/933,806

[22] Filed: Sep. 19, 1997

[51] Int. Cl.[6] ..... F42D 3/00

[52] U.S. Cl. ..... 102/333

[58] Field of Search ..... 102/333

[56] References Cited

U.S. PATENT DOCUMENTS

| | | | |
|---|---|---|---|
| 1,979,802 | 11/1934 | Kinley | 102/333 X |
| 2,403,386 | 7/1946 | Lubelsky et al. | 102/333 |
| 3,126,827 | 3/1964 | McReynolds, Jr. | 102/333 |
| 3,208,381 | 9/1965 | Kihlstrom et al. | 102/333 |
| 3,264,992 | 8/1966 | Beck | 102/333 |
| 3,608,491 | 9/1971 | Botes | 102/333 |
| 4,464,994 | 8/1984 | Porter | 102/333 |
| 4,470,352 | 9/1984 | Leperre | 102/333 |
| 4,492,165 | 1/1985 | Marz | 102/333 |
| 4,660,644 | 4/1987 | Egnor | 102/333 X |
| 4,754,705 | 7/1988 | Worsey | 102/333 |
| 5,092,245 | 3/1992 | Douglas et al. | 102/333 X |
| 5,198,613 | 3/1993 | Jenkins, Jr. | 102/333 X |

FOREIGN PATENT DOCUMENTS

| | | | |
|---|---|---|---|
| 101332 | 10/1925 | Austria | 102/333 |

OTHER PUBLICATIONS

Pit & Quarry, Jan. 1995, Blasting Up Close Stem Tite Blast Control Plugs, advertising.

Max–Blast Stemming Plugs advertising, Skaggs Bit & Tool Co., St. Louis, MO The Blast Stops Here advertising, Caps Grips & Plugs, Inc. Jan. 1, 1996.

"Explosives," The Journal of Explosives Engineering, Nov./Dec. 1996 Pit & Quarry, Sep. 1996, Stemming the Tide by Richard O'Meara.

*Primary Examiner*—Peter A. Nelson

*Attorney, Agent, or Firm*—Paul M. Denk

[57] ABSTRACT

A stemming plug constructed from a durable, resilient material and comprising a circumferential wall defining an inner cavity, an end wall at the first end and an open second end. In the preferred embodiment, the circumferential wall is fluted so that it can easily compress and seat in a borehole while maintaining a snug friction fit. The plug is inserted in the borehole over the explosive charge. Stemming material, preferably rock, is placed on top of the plug. The stemming material covers the top and slides down around the circumferential wall and is lodged between the circumferential wall and the borehole. Upon explosion, the blast energy is forced into the inner cavity causing the circumferential wall to expand outwardly and thereby engaging the stemming material and the borehole wall to secure the plug in place. The stemming material can also be placed inside the plug, with blast energy inverting the plug end wall to wedge stemming material within the borehole.

7 Claims, 5 Drawing Sheets

BLASTING STEMMING PLUG

BACKGROUND OF THE INVENTION

The present invention relates generally to explosive device and, in particular, to a stemming plug to be used in a borehole.

Stemming materials and plugs for use in boreholes or blast holes are known to the art. Stemming is the process in which material is placed into a bored blast hole on top of the explosive charge to contain or confine the explosive energy. Stemming the borehole keeps the blast energy from escaping out of the hole and concentrates the explosive energy within the blast hole. For example, if the user is blasting in rock, stemming improves fragmentation of the solid rock around the blast and increases the production of crushed rock. Further, stemming material can prevent contamination of the charge in the blast hole and also reduces the amount of ejected material.

Traditionally, blasters have used the indigenous material to stem the borehole. For example, in rock quarries or other accessible locations, crushed rock is the preferred stemming material. Coal mines use drill cuttings as stemming since crushed rock is not available. However, in wet conditions, drill cuttings are unsatisfactory because they offer little confinement of the blast, blowing out of the borehole in a stream of mud.

Mechanical stemming plugs also are used to confine the blast in the borehole. Tamping of boreholes to contain a explosive charge was taught almost 150 years ago in the "Rudimentary Treatise on the Blasting and Quarrying of Stone" by Maj.-Gen. Sir John Burgoyne, London, 1849. Gen. Burgoyne taught the use of iron tamping plugs in the shape of a barrel, a cone and a cone with wedges. Generally, then as now, the stemming plug is placed above the charge to enhance and hold the stemming material such as crushed rock. Mechanical stemming using a conical stem is shown in U.S. Pat. No. 4,754,705, to Worsey. When use correctly, stemming plugs can reduce flyrock, improve fragmentation, reduce airblast, expand borehole patterns and increase crushing. Such improvements allow the use of less explosive powder per ton of finished product.

The prior art stemming plugs, from Burgoyne to Worsey have similar failings. The substantially rigid, formed plugs normally do not fit snugly in the borehole and frequently require the use of alignment tools that do not always properly aligned the plug in the borehole. Air decking applications are not feasible with these rigid stemming plugs due to variations in borehole sizes.

Borehole size variations are also possible with gradual wearing of the drill. It is common for hole sizes to be undersized as much as ¼ inch in diameter. Some stemming plugs function well in a smooth and consistent drill hole diameter, but collapse as the outer circumference of the plug proves too large for the reduced hole circumference. A stemming plug is needed to eliminate concern over borehole diameter variations and any irregular borehole surface, such as a protruding rock that can obstruct the rigid stemming plugs during insertion or which may collapse other, more flexible designs.

It would, therefore, be advantageous to have a stemming plug that is easily seated in the borehole, that does not require the use of an alignment tool, that can conform to varied circumferences and shapes of the borehole, can minimize contamination of the borehole and function in air decking and pre-split applications.

SUMMARY OF THE INVENTION

It is, therefore, among the principal objects of the present invention to provide a stemming plug that can seat in the borehole and maintain an adequate seal under various applications.

It is another object of the present invention to provide a stemming plug that can be used in air decking applications and hold an appropriate amount of stemming material without slipping.

It is another object of the present invention to provide a stemming plug that will not collapse in a reduced borehole diameter resulting from a worn drill or irregular hole surface.

It is still another object of the present invention to provide a stemming plug that cooperates with stemming material placed on top and around the plug to lodge the plug into place under an explosive force.

Still another object of the present invention is to provide such a stemming plug that is easy to install and is self-aligning and self-centering without the use of an alignment tool.

Another object of the present invention is to provide such a stemming plug that is constructed from a durable, resilient material.

Yet another object of the present invention is to provide such a stemming plug that prevents the infiltration of moisture and foreign objects into the borehole.

Another object of the present invention is to provide such a stemming plug that allows for a reduction in explosive powder by holding the charge and the stemming material in a desired area of a rock formation.

In accordance with the invention, generally stated, a stemming plug is provided constructed from a durable, resilient material comprising a circumferential wall defining an inner cavity, a top wall at the first end and an open second end. In the preferred embodiment, the circumferential wall is fluted so that it can easily compress and seat in a borehole while maintaining a snug friction fit. The plug is inserted in the borehole over the explosive charge. Stemming material, preferably rock, is placed on top of the plug. The stemming material covers the top and slides down around the circumferential wall and is lodged between the circumferential wall and the borehole. Upon explosion, the blast energy forces stemming material into the cavity causing the circumferential wall to expand outwardly and thereby engaging the stemming material and the borehole wall to secure the plug in place. As the blast proceeds, the flexibility of the cap allows the center to move upward locking the stemming material against the outside walls thereby confining the explosive charge in the desired area of the borehole and preventing ejection of the plug and stemming material as well as preventing airblast.

DESCRIPTION OF THE PREFERRED EMBODIMENT

Figure 1:
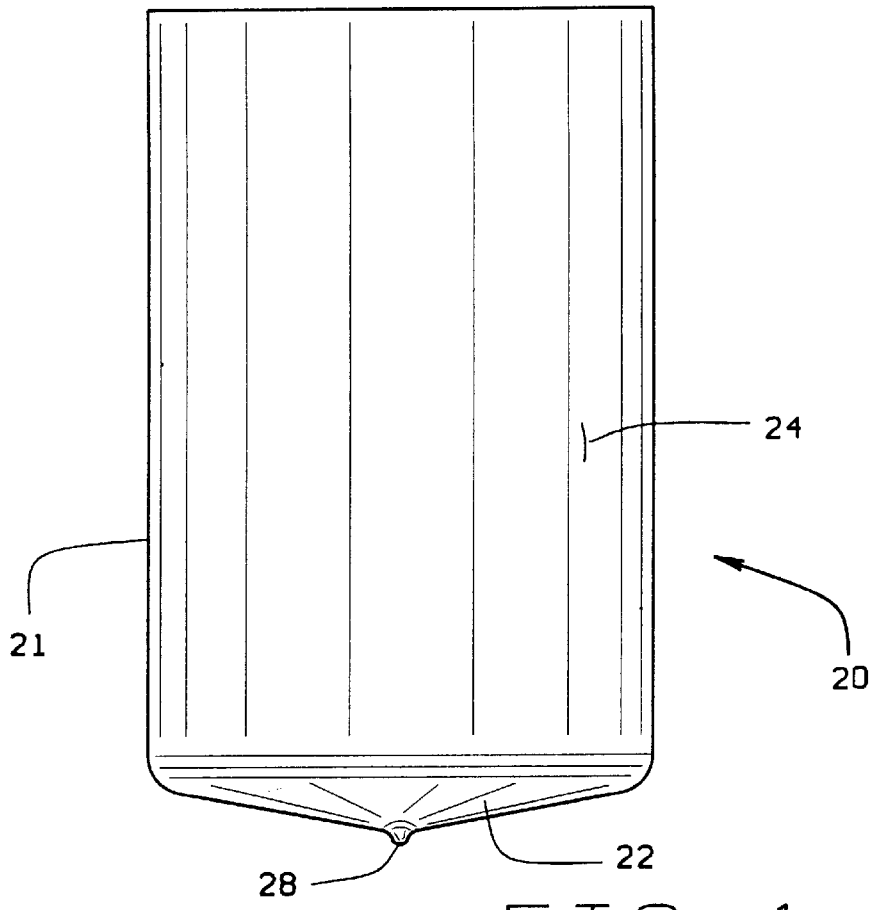
FIG. 1 is a side elevation view of a stemming plug of the present invention.
Figure 2:
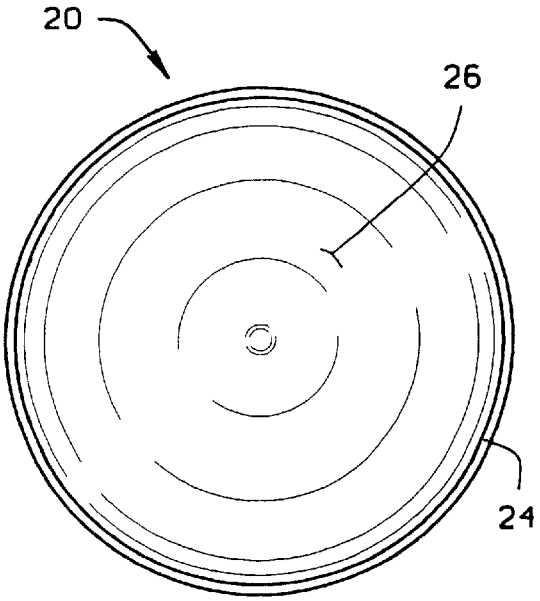
FIG. 2 is a top plan view thereof.
Figure 3:
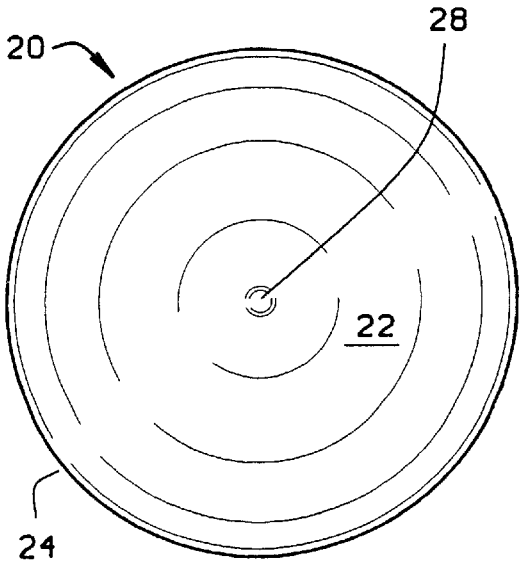
FIG. 3 is a bottom plan view thereof.

A stemming plug of the present invention is indicated generally by reference numeral 20 in FIGS. 1–3. Plug 20 has a substantially cylindrical body 21 having bottom wall 22 and an integral circumferential side wall 24 which defines an inner cavity 26. Bottom wall 22 has a raised nipple at its center and slopes gently upward at an angle from nipple 28 to the juncture with circumferential wall 24. This embodiment does not require stemming material between it and the blast charge. It will be appreciated that plug 20 is constructed from a resilient, flexible material such as PVC urethane, rubber or similar material, preferably molded as one piece.

Figure 4:
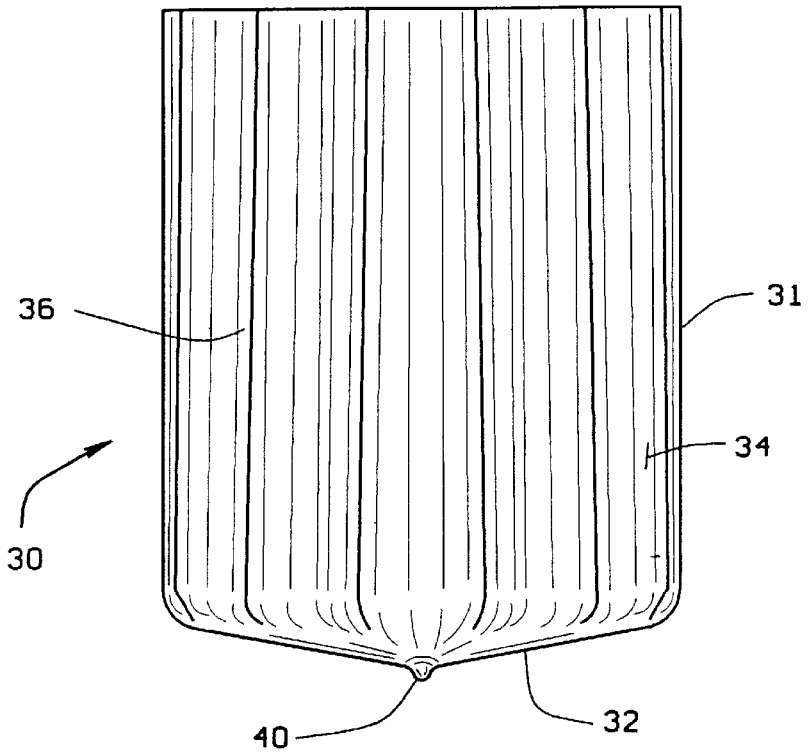
FIG. 4 is a side elevation view of another embodiment of the stemming plug of the present invention.
Figure 5:
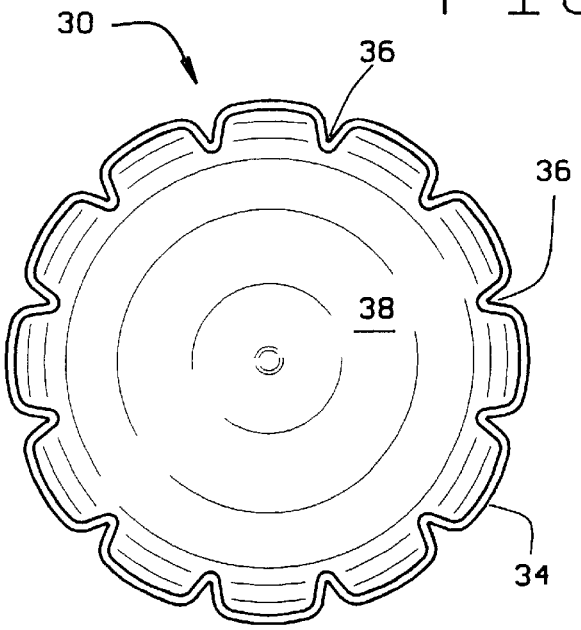
FIG. 5 is a top plan view thereof.
Figure 6:
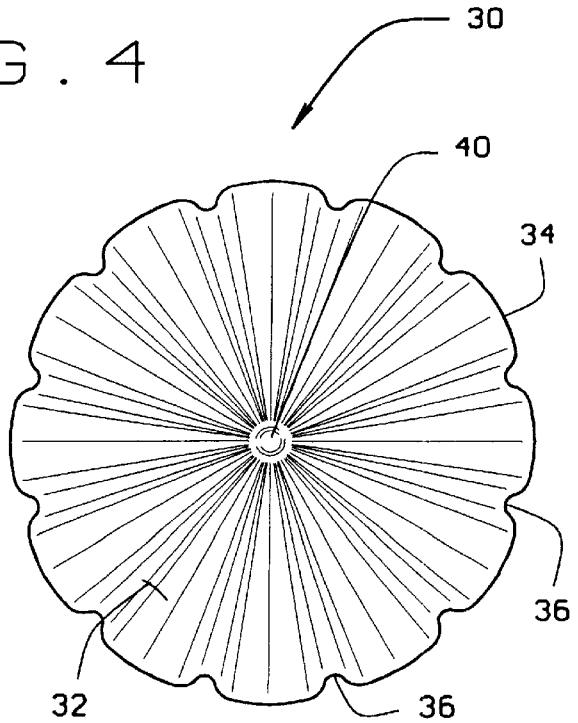
FIG. 6 is a bottom plan view thereof.
Figure 7:
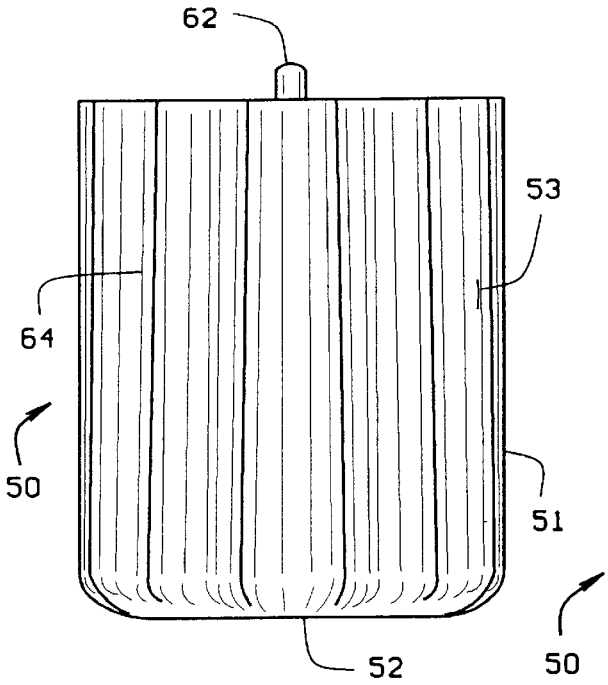
FIG. 7 is a side elevation view of another embodiment of the stemming plug of the present invention.
Figure 10:
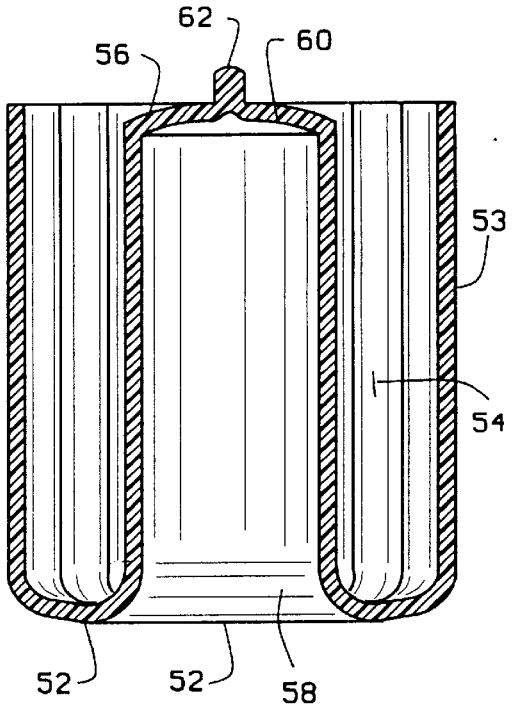
FIG. 10 is a cross-sectional view thereof take along line 10—10 of FIG. 8.
Figure 8:
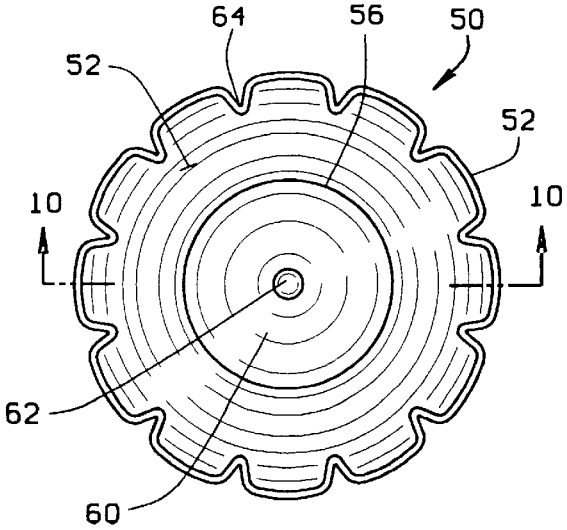
FIG. 8 is a top plan view thereof.
Figure 9:
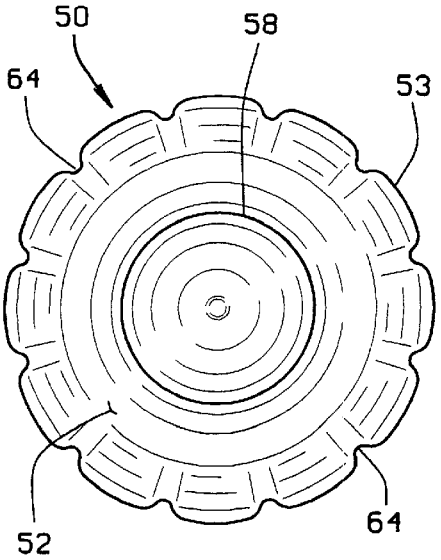
FIG. 9 is a bottom plan view thereof.

Another embodiment of the stemming plug of the present invention is indicated generally by reference numeral 30 in FIGS. 4–6. Plug 30 also has a substantially cylindrical body 31 and includes a bottom wall 32 and an integral circumferential sidewall 34. As best seen in FIGS. 5 and 6, circumferential wall 34 includes a plurality of evenly spaced apart flutes 36. Obviously, these flutes 36 need not necessarily be evenly spaced apart, as explained herein and shown in the drawings, since the plug will function just as effectively if these flutes are spaced apart at different dimensions, or at uneven spacings. It will be appreciated that flutes 36 allow wall 34 to be slightly compressed for introduction into a borehole with wide diameter tolerances without collapsing. This embodiment does not require stemming material between it and the blast charge. After the plug is inserted into the borehole stemming material is poured into the borehole, filling the cavity in the plug. Sidewall 34 defines an inner cavity 38. Bottom wall 32 has a centrally placed nipple 40 and tapers gently upward to the juncture of the bottom wall and the circumferential wall 34. Plug 30 is constructed from a flexible, resilient material such as PVC, urethane or rubber, preferably molded in one piece.

Another alternative embodiment of the stemming plug of the present invention is indicated generally by reference numeral 50 in FIGS. 7–10. Plug 50 has a substantially cylindrical body 51 having a bottom wall 52 and a depending circumferential wall 53 defining an inner cavity 54. Plug 50 has an integral inner depending tube 56 having bottom 58 which opens into top wall 51 and a lower or closed end 60. Closed end 60 includes a nipple 62. Circumferential 52 includes a plurality of flutes 64 which allow the wall to be compressed when the plug is seated in a borehole and also allows a small amount of stemming material, such as crushed rock, to seat within the flutes between the borehole wall and the plug. Plug 50 preferably is constructed from a resilient, flexible material as previously described.

Figure 11:
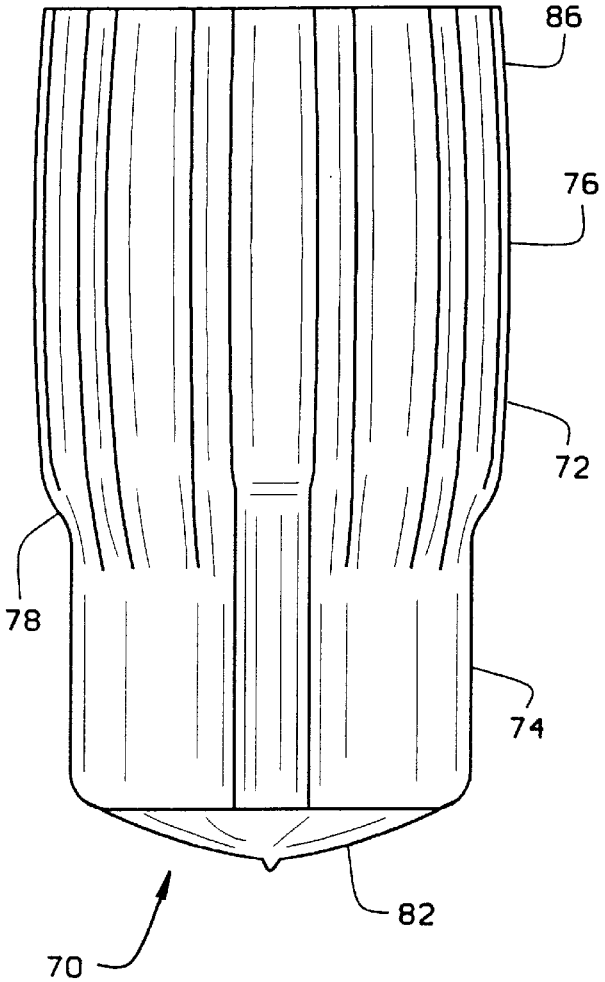
FIG. 11 is a side elevation view of another embodiment of the stemming plug of the present invention.
Figure 12:
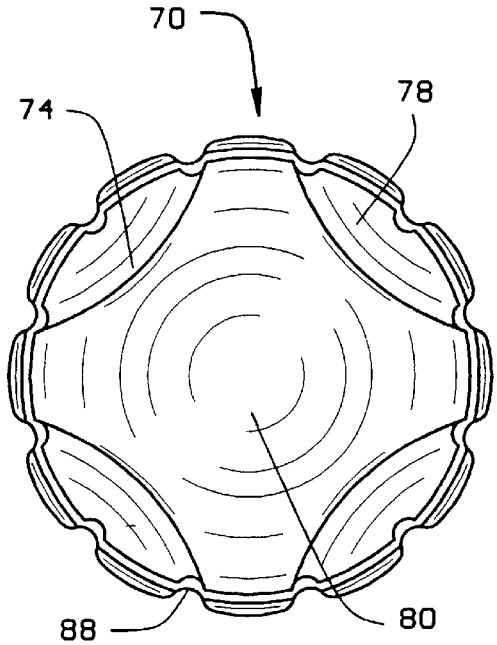
FIG. 12 is a bottom plan view thereof.
Figure 13:
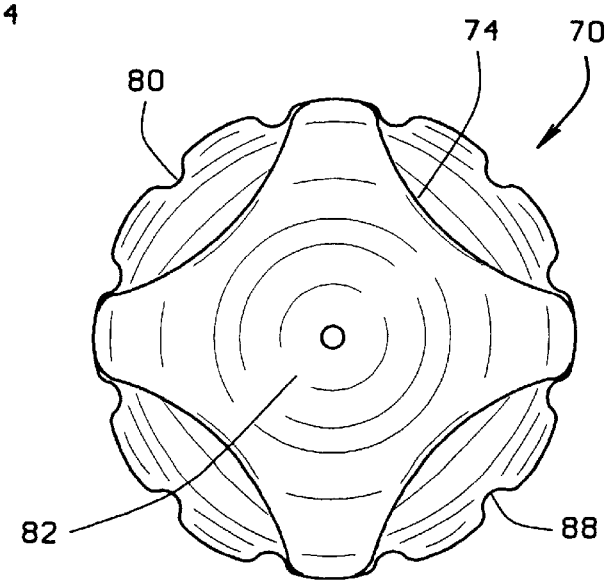
FIG. 13 is a top plan view thereof.

FIGS. 11–13 illustrate another preferred embodiment of the stemming plug of the present invention, indicated generally by reference numeral 70. Plug 70 has a hollow elongated body 72 with a substantially rectangular upper section 74 and a substantially cylindrical lower section 76 with a shoulder 78 at the juncture of the upper and lower sections. The lower section has a greater cross-sectional area than the upper section. The body 72 defines an inner cavity 80. Upper section 74 has a top wall 82 with a centrally position nipple 84. Top wall 82 slopes downward from the nipple to the upper section walls. Lower section 76 includes an inward taper as at 86 and a plurality of flutes 88 to facilitate introduction into a borehole.

The respective embodiments of the present invention generally are used in the same manner. A borehole is drilled in the rock, for example, to a depth required to set an explosive charge. The explosive charge is placed at the desired depth in the hole. Stemming material can be used in an air decking arrangement, without the stemming material on the charge, as will be explained below. The plug is inserted with a wooden stick or other elongated, non-sparking tool with the open end (FIG. 12) inserted into the borehole first. Because the plug of the present invention is made from a flexible, resilient material, the plug easily can be positioned in the borehole by ramming in with the tool. Referring particularly to plug 30 (FIGS. 4–6) and plug 50 (FIGS. 7–10) the flutes allow the plug to be slightly deformed to conform to the diameter of the hole. Stemming material, such as crushed rock is placed on top of the plug. Since the top wall of the plug is angled, the stemming material is directed around the peripheral edge of the top wall of the plug, assuring good coverage. Generally, about 1 foot of stemming material is placed on the plug for each inch of diameter of the borehole. For example, if the borehole has a 3 inch diameter, 3 feet of crushed rock is placed on top of the plug. With regard to plugs 30 and 50, some stemming material will slide into the flutes and be lodged between the plug and the wall of the borehole but generally does not slide beyond the plug. Since the plug is lodged in the borehole, it does not slip and the stemming material does not force the plug of the present invention down into the borehole.

Referring now to plugs 20 and 30, when the explosive charge is set off, the upward force of the blast will cause the closed ends 22 and 32 respectively to be inverted, wedging stemming material within the plug and forcing against borehole wall. Within plug 30, since there can be stemming material lodged in the flutes, greater wedging is possible to resist the upward force of the blast. and forced against the stemming material to additionally lodge the plug in place.

Referring now to plug 50 (FIGS. 7–10), bottom wall 52 is inserted first into the borehole with the stemming material filling area 54. When the blast force enters opening 58 the inner tube 60 is forced outwardly wedging the rock within opening 58 against the outer wall 53 and the borehole wall.

Referring now to plug 70 (FIGS. 11–13), the plug is placed in the borehole and covered with stemming material. The stemming material surrounds upper section 74 and rests on shoulder 78, thereby lodging the upper end of the plug in the stemming material. Some stemming material can be caught in the flutes 88. When the charge is set, the upward force of the blasts spreads lower section 76 and urges it against the borehole wall while, simultaneously, the upper section 74 is driven into the stemming material, thereby securing plug 70 in place. Furthermore, the slightly tapered top wall of the plug is urged upward and forced against the stemming material to additionally lodge the plug in place.

Figure 14:
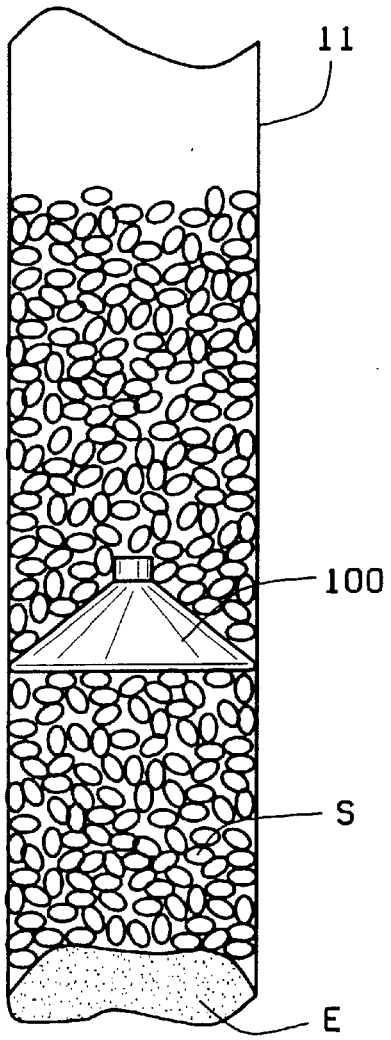
FIG. 14 PRIOR ART
FIG. 14 is a prior art funnel-shaped view.
Figure 15:
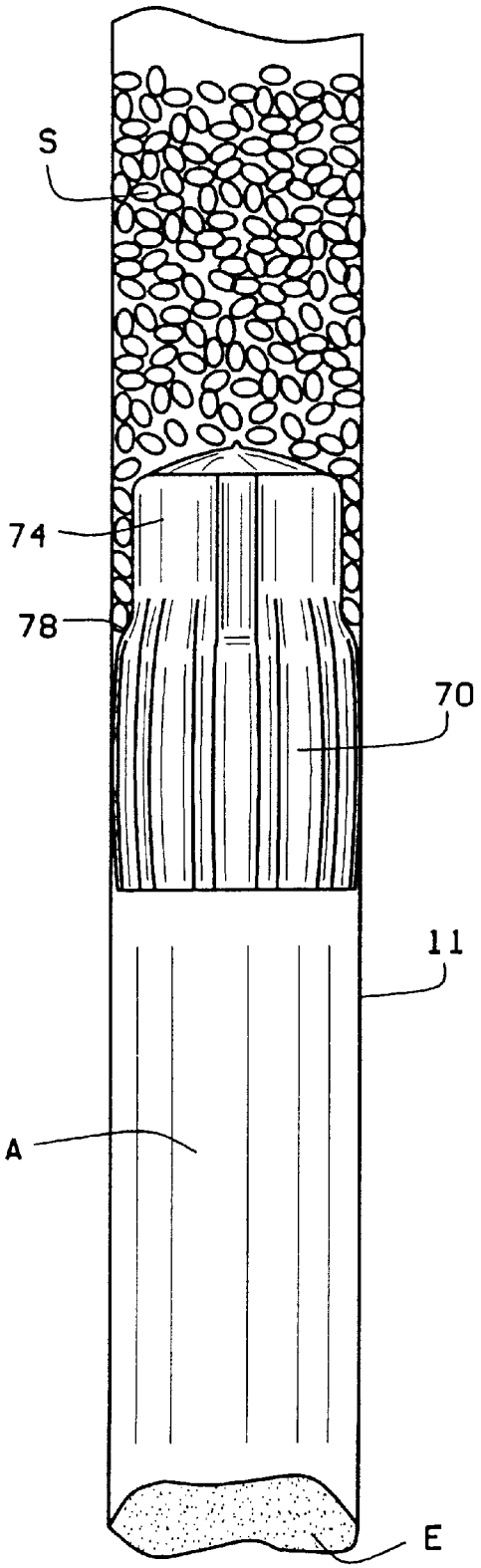
FIG. 15 is another embodiment of the stemming plug of the invention.

The use of plug 70 in an air decking application is illustrated in FIG. 15. For purposes of comparison FIG. 14 illustrates the use of a prior art, funnel-shaped stemming plug 100. As can be seen in FIG. 14, an explosive charge E is placed in borehole H. Stemming material S, preferably crushed rock, is placed on the charge E. The plug 100 is placed on top of the stemming material. Additional stemming materials placed on plug 100. This arrangement is unsatisfactory for air decking. Also, as the funnel-shaped stemming plug 100 is slightly undersized relative to the hole, it can tip or be placed at an angle reducing its effectiveness in wedging into stemming material.

As shown in FIG. 15, illustrating a method of the present invention, an explosive charge E is placed in borehole H. An air space or air decking A is left above charge E. Plug 70 is inserted into borehole H. Stemming material S is placed on plug 70, generally 1 foot for each inch of diameter of borehole H. As can be appreciated from FIG. 15, stemming material surrounds upper section 74 but is prevented from falling deeper into the hole because of the greater diameter of lower section 76, i.e., the stemming material S rests on shoulder 78. Due to the expansive nature of plug 70, it can be appropriately positioned in the borehole and support the stemming material to create air decking A. As stated above, the plug of the present invention will not slip and will maintain the air decking A. The presence of air decking A allows for a concentrated blast in that area for more effective blasting. Although the air decking application is illustrated with plug 70, it will be understood that each of the embodiments of the plug of the present invention can be used in air decking applications.

As can be appreciated by those skilled in the art, various changes and modifications may be made in the stemming plug of the present invention without departing from the scope of the appended claims. Therefore, the foregoing description and accompanying drawings are intended to be illustrative only and should not be construed in a limiting sense.

We claim:

1. An integral one piece stemming plug for introduction into a blasting borehole comprising:

a substantially cylindrical body having a first end and a second end, said cylindrical body including a circumferential wall defining an inner cavity;

said cylindrical body having a diameter greater than the diameter of any borehole into which it locates;

a wall across said first end;

said cylindrical body and wall being impervious and forming a seal in the borehole when a charge is exploded;

said circumferential wall being formed of a resilient, flexible material so that when an explosive charge is set below said plug, the explosive force entering said inner cavity causes the circumferential wall to expand against the borehole thereby securing the plug within the borehole.

2. The plug of claim 1 wherein said circumferential wall has a plurality of flutes formed therein.

3. The plug of claim 1 wherein the resilient, flexible material is selected from the group containing PVC, rubber and urethane.

4. The plug of claim 1 and further comprising a tube extending from said wall across said first and into said inner cavity.

5. An integral one piece stemming plug for introduction into a blasting borehole comprising:

an elongated hollow body, said body having a substantially rectangular first section and an integral substantially cylindrical second section, said elongated body defining an inner cavity within said first and second sections, the cylindrical second section having a greater cross-sectional area than the rectangular first section, an integral wall formed across said substantially rectangular first section, said cylindrical second section having a diameter greater than the diameter of the borehole into which the plug locates, said substantially cylindrical second section and its first end wall, in combination with the substantially rectangular first section being impervious and forming a seal in the borehole when a charge is exploded, said cylindrical second section being formed of a resilient, flexible material so that when an explosive charge is set below said plug, the explosive force entering said inner cavity causes the circumferential wall to expand against the borehole thereby securing the plug within the borehole.

6. The stemming plug of claim 5 wherein said cylindrical second section has a plurality of flutes formed therein.

7. The stemming plug of claim 5 wherein said elongated hollow body is molded from a flexible, resilient material that allows the plug to conform to a borehole.

* * * * *